US009414169B2

(12) United States Patent
Kim

(10) Patent No.: US 9,414,169 B2
(45) Date of Patent: Aug. 9, 2016

(54) DEVICE AND METHOD FOR DETECTING CHANGE IN CHARACTERISTICS OF HEARING AID

(71) Applicant: Samsung Electronics Co., Ltd., Gyeonggi-do (KR)

(72) Inventor: Yangwook Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 94 days.

(21) Appl. No.: 14/532,346

(22) Filed: Nov. 4, 2014

(65) Prior Publication Data

US 2015/0124985 A1 May 7, 2015

(30) Foreign Application Priority Data

Nov. 6, 2013 (KR) ..... 10-2013-0134354

(51) Int. Cl.
*H04R 29/00* (2006.01)
*H04R 25/00* (2006.01)

(52) U.S. Cl.
CPC ..... *H04R 25/30* (2013.01); *H04R 25/554* (2013.01); *H04R 2225/41* (2013.01); *H04R 2225/61* (2013.01)

(58) Field of Classification Search
CPC .. H04R 25/30; H04R 2225/41; H04R 25/554; H04R 2225/61
USPC ..... 381/60, 23.1, 312
See application file for complete search history.

(56) References Cited

U.S. PATENT DOCUMENTS

2003/0007647 A1* 1/2003 Nielsen ..... H04R 25/305 381/60

FOREIGN PATENT DOCUMENTS

KR 10-0633122 B1 9/2006

* cited by examiner

*Primary Examiner* — Paul S Kim
(74) *Attorney, Agent, or Firm* — Cha & Reiter, LLC.

(57) ABSTRACT

The present invention relates to a device and a method for detecting a change in characteristics of a hearing aid and informing a user of the change. In one embodiment, a first input audio signal and an second amplified audio signal transmitted from the a hearing aid are received via a communication unit. Simulation is conducted of amplifying of the first input audio signal according to pre-stored auditory information stored in advance, and the processed simulated amplified first input audio signal is compared with the amplified audio signal. An alarm signal is output when a difference between the processed simulated amplified first input audio signal and the second amplified audio signal is greater than a predetermined threshold.

20 Claims, 9 Drawing Sheets

DEVICE AND METHOD FOR DETECTING CHANGE IN CHARACTERISTICS OF HEARING AID

CROSS-REFERENCE TO RELATED APPLICATION

This application claims priority from and the benefit under 35 U.S.C. §119(a) of Korean Patent Application No. 10-2013-0134354, filed on Nov. 6, 2013, which is hereby incorporated by reference for all purposes as if fully set forth herein.

TECHNICAL FIELD

Various embodiments of the present invention relate to a device and a method for detecting a change in characteristics of a hearing aid and informing a user of the change.

BACKGROUND

As society evolves into an aging society, there are an increasing number of patients suffering from aging-associated diseases. A representative example of the aging-associated diseases is hearing loss caused by degradation of hearing ability. Most of the patients with hearing loss can solve many problems caused by the loss of hearing with a hearing aid.

The hearing aid is used by patients with aging-associated hearing loss but also by patients whose hearing is imperfect by nature, accidents trauma or various diseases. The hearing aid operates by amplifying sound to suit the auditory characteristics of the patients, who are diagnosed with hearing loss through a hearing test by a professional organization such as an Ear, Nose, and Throat (ENT) clinic, while being worn on an ear of the patients.

The hearing aid consists of a microphone for collecting sounds, an amplifier for amplifying the collected sounds, a speaker or a receiver for outputting the amplified sounds, and the like. In particular, besides the elements of the existing hearing aid, a digital hearing aid may further include a CODEC or a D/A and A/D converter for conversion between a digital signal and an analog signal, a controller (or a processor) for controlling amplification or conversion of a digital signal through various algorithms, an interface that can be connected with an external computer, and the like.

Meanwhile, a suitable form of a hearing aid may vary depending on the type of hearing loss to be remedied. For example, people having difficulty in hearing sounds across the whole band or in the low frequency band generally use an in-the-ear hearing aid. The in-the-ear hearing aid is inserted into the external auditory meatus of the ear. However, each patient is unique, and typically suffers from an inability to hear a specific frequency band of sound. Of course, some patients may have difficulty in hearing sounds over the entire audio frequency band, and yet, even in these cases, there is typically a frequency band in which sounds are relatively more indistinct.

Accordingly, the patients with hearing loss visit a professional organization such as an Ear, Nose, and Throat (ENT) clinic to have their hearing tested by a doctor or a special audiologist (or auditory therapist). In the hearing test, the doctor or the special audiologist measures an auditory state of a patient including a magnitude of the least audible sound, a magnitude of the most comfortable sound to listen to, a magnitude of an unpleasant sound, and the like, and then determines a range or a degree with which to amplify a sound based on the measurement results, thus identifying an overall auditory state of the patient. Further, the doctor or special audiologist may identify a degree that the patients can recognize a bit of speech by carrying out speech audiometry. Thereafter, the characteristics of a suitable hearing aid can be determined from this information.

The patients cannot use the hearing aids comfortably until the characteristics of the hearing aids (e.g., such as an amplification factor) are adjusted such that the patients can accurately hear sounds. Although the hearing aids generally have a lifespan of three to five years, the characteristics of the hearing aids (e.g., such as the amplification factor) may benefit from adjustment for various reasons, or the hearing aids themselves may have to be replaced.

For example, aging-associated hearing loss can worsen with advancing years, and in this case, the characteristics of the hearing aids may not be appropriate as more time passes. Therefore the hearing aids may become ineffective, causing inconvenience for patients with hearing loss.

In some cases, the characteristics of the hearing aids such as the amplification factor may have changed due to a malfunction within the hearing aids themselves. For example, improper maintenance of the hearing aid, microphone or receiver may cause break downs and cessation of functions. Furthermore, software errors may lead to abnormalities in the hearing aid algorithm.

Patients who utilize the hearing aids may not be able to readily identify whether their hearing abilities have worsened, or whether there is a problem with the hearing aid. Identifying which is true may often require the patients to visit a hospital.

SUMMARY

Accordingly, in one aspect of the present invention, a device and a method is provided which facilitates detection of a change in the characteristics of a hearing aid or an abnormality in a receiver of the hearing aid, thereby making it possible for a patient wearing the hearing aid to easily identify the change or the abnormality.

Another aspect of the present invention is to provide a device and a method which can detect abnormality in a microphone of a hearing aid, thereby making it possible for a patient wearing the hearing aid to easily identify the abnormality of the microphone.

In accordance with one aspect of the present invention, a method of detecting a change in characteristics of a hearing aid by an electronic device is provided. The method includes: receiving via a communication unit an input audio signal and an amplified audio signal transmitted from a hearing aid, simulating amplification of the input audio signal according to pre-stored auditory information and comparing the simulated amplified input audio signal and the amplified audio signal, and outputting an alarm signal when a difference between the simulated amplified input audio signal and the amplified audio signal is greater than a predetermined threshold. In accordance with another aspect of the present invention, a method of detecting a change in characteristics of the hearing aid is provided. The method includes: acquiring by a processor an input audio signal and an amplified audio signal, simulating by a processor amplification of the input audio signal according to pre-stored auditory information to generate a simulated amplified audio signal, comparing the simulated amplified audio signal with the amplified audio signal fed back from an output route of the amplified audio signal through the hearing aid. and outputting an alarm signal when a difference between the simulated amplified input audio signal and the fed back amplified audio signal is beyond a predetermined threshold. In accordance with another aspect of the present invention, a device for detecting a change in characteristics of a hearing aid is provided. The device includes: a communication unit configured to communicate with the hearing aid, a display unit configured to display notifications of abnormalities in the hearing aid, a memory configured to store an amplification factor of the hearing aid and an allowable error range of the amplification factor, and a controller. The controller is configured to receive via the communication unit an input audio signal and an amplified audio signal transmitted from the hearing aid, simulate amplification of the input audio signal utilizing the amplification factor stored in the memory and compare the simulated amplified input audio signal with the amplified audio signal, and display an alarm signal on the display unit when a difference between the simulated amplified input audio signal and the amplified audio signal is greater than a predetermined threshold. In accordance with another aspect of the present invention, a device for detecting a change in characteristics of a hearing aid is provided. The device includes: a memory that stores an amplification factor of auditory information and an allowable error range for detection of a malfunction, and a controller configured to collect, via a microphone, sound in a pre-configured audio frequency band as an electrical audio signal, amplify, via an amplifier, the electrical audio signal that is output from the microphone according to pre-stored auditory information, convert and output the amplified electrical audio signal as an audible sound signal, compare, with reference to the allowable error range, the audible sound signal with a signal generated by amplifying the electrical audio signal by the amplification factor to detect if the audible sound signal is fed back through an output route to a speaker, and generate an alarm when a difference between the audible sound signal and the signal generated by amplified the electrical audio signal is greater than the allowable error range. As described above, according to the present invention, a patient hard of hearing, using a hearing aid, can determine whether there is a problem with the hearing aid or his/her hearing ability has been further worsened, even without visiting a hospital. Furthermore, this leads the patient to take a rapid action, thereby minimizing inconvenience.

BRIEF DESCRIPTION OF THE DRAWINGS

The above features of the present invention will be more apparent from the following detailed description in conjunction with the accompanying drawings, in which.

DETAILED DESCRIPTION

Hereinafter, the present invention will be described with reference to the accompanying drawings. The accompanying drawings of the present invention are provided in order to help understanding of the present invention, and it should be noted that the present invention is not limited to a form, disposition and the like which are exemplified in the accompanying drawings of the present invention. Also, equivalents or extensions of additional embodiments illustrated in the accompanying drawings of the present invention should be understood from the following description, taken in connection with the accompanying drawings.

Figure 1:
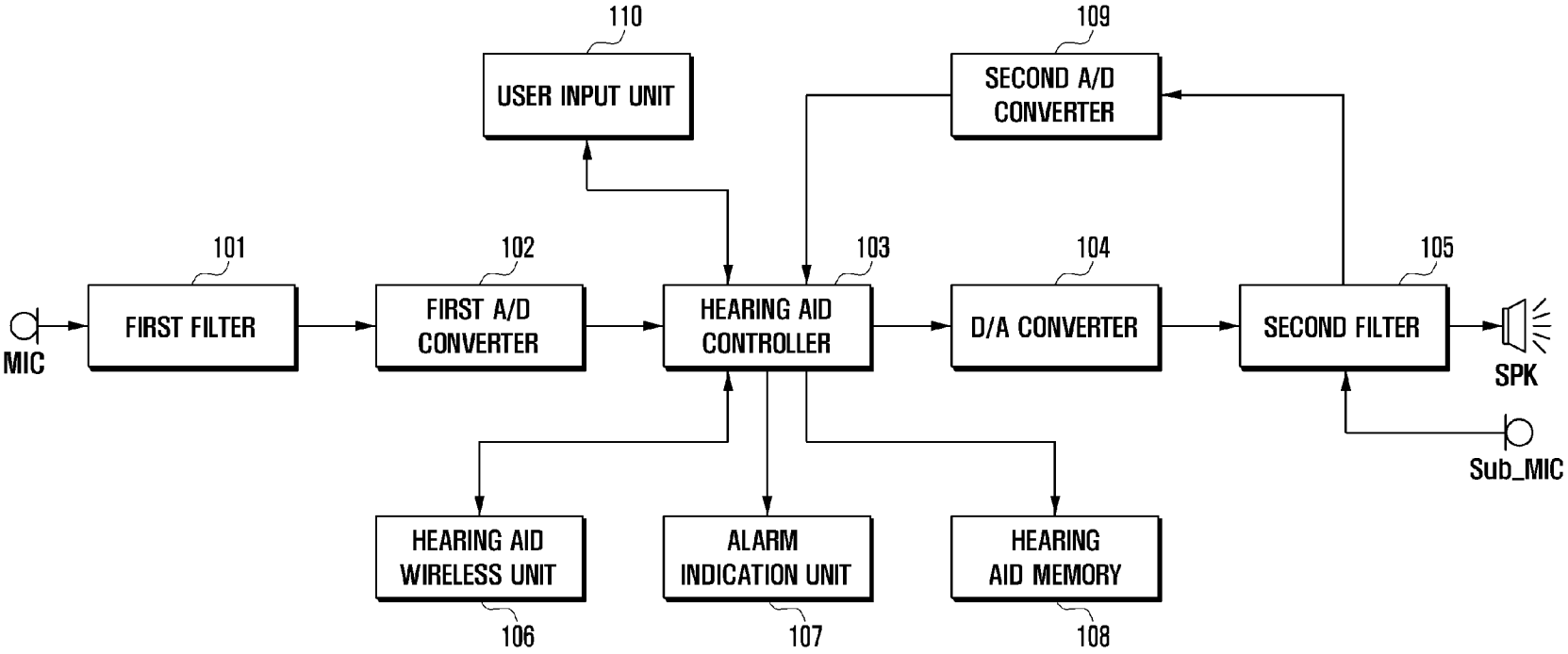
FIG. 1 is a block diagram illustrating internal configurations of an example digital hearing aid to which the present invention is applied.

FIG. 1 is a block diagram illustrating internal configurations of an example digital hearing aid to which the present invention is applied.

A hearing aid may be divided into an analog hearing aid and a digital hearing aid. The analog hearing aid amplifies an analog signal as it is and provides it, and the digital hearing aid converts an analog signal into a digital signal and performs such an operation as amplification, etc. While the present invention may be applied to both the analog hearing aid and the digital hearing aid, for convenience of description, the digital hearing aid will be described as an example of the hearing aid. FIG. 1 illustrates configurations of a digital hearing aid.

The configurations illustrated in FIG. 1 may be broadly divided into configurations for amplifying sounds, which is a unique operation of the hearing aid, and configurations for diagnosing a state of the hearing aid or a state of a wearer according to the present invention. The hearing aid may include a microphone (MIC), a first filter 101, a first analog-to-digital converter 102, a hearing aid controller 103, a digital-to-analog converter 104, a second filter 105, a speaker (SPK), and a second analog-to-digital converter 109. Here, the first filter 101, the second filter 105, and the second analog-to-digital converter 109 may be omitted in some cases. Furthermore, in other cases, the hearing aid controller 103 may also be separated into an amplifier and a hearing aid control unit.

The configurations for a digital hearing aid configured to diagnose the state of the hearing aid or the state of the wearer according to the present invention may further include the hearing aid controller 103, a hearing aid wireless unit 106, an alarm indication unit 107, a hearing aid memory 108, the second analog-to-digital converter 109, and a user input unit 110. Furthermore, the configurations may also include the hearing aid memory 108 and the alarm indication unit 107.

In the other cases, some configurations may be added to and other configurations may be removed from such configurations as described above. The addition or removal of the configurations may be confirmed based on the following descriptions.

Unique operation of the hearing aid and the operations for identifying the state of the hearing aid and the state of the hearing aid wearer will be described according to various embodiments of the present invention.

The microphone (MIC) receives an input of an acoustic signal in the atmosphere. The microphone (MIC) may receive an input of an acoustic signal in the audio frequency band or a pre-configured specific frequency band and convert the acoustic signal into an electric audio signal to output it. Accordingly, the signal output from the microphone (MIC) is an electric analog audio signal. The electric analog audio signal output from the microphone (MIC) is input to the first filter 101. The first filter 101 filters out an input signal according to auditory characteristics of the hearing aid wearer or extracts the signal in the audio frequency band. Further, the first filter 101 may combine an anti-aliasing operation for making sounds uniform and smooth with the filtering or extracting operation.

The analog signal filtered out and output by the first filter 101 is input to the first analog-to-digital converter 102 and converted into digital data according to a pre-configured method. The digital data output from the first analog-to-digital converter 102 is input to the hearing aid controller 103. A signal input from the microphone (MIC) may be directly input to the first analog-to-digital converter 102, and digital data output from the first analog-to-digital converter 102 may be input to the first filter 101. Alternatively, the first filter 101 may be omitted. The following description is made under the assumption that the first filter 101 is included.

The digital data output from the first analog-to-digital converter 102 may be input to the hearing aid controller 103, or may be divided into two pieces of data, one of which may be input to the hearing aid controller 103, and the other of which may be stored in the hearing aid memory 108. The following description is made assuming that the digital data is input to the hearing aid controller 103. Furthermore, the digital data output from the first analog-to-digital converter 102 may be an input characteristic signal.

The hearing aid controller 103 may perform four main control operations. First, the hearing aid controller 103 controls amplification of the input digital data, the amplification being a basic control operation for the hearing aid. The hearing aid controller 103 makes a control to amplify the input digital data by an amplification factor configured for each preset band or channel and output the amplified data. Depending on the type of hearing aid, the hearing aid may be separately provided with a hardware amplifier, and the hearing aid controller 103 may also control such that the digital data may be amplified and output by the speaker (SPK) through software. The amplification factor configured for each frequency band or channel is a value configured in advance depending on the auditory characteristics of the hearing aid wearer, and may be adjusted usually through a hospital or a hearing aid shop. The digital data amplified by the hearing aid controller 103 as described above may be an output characteristic signal.

Second, the hearing aid controller 103 may perform a control to store the input digital data and the data amplified by the hearing aid controller 103 in the hearing aid memory 108 at a predetermined period or continuously. Furthermore, when the second analog-to-digital converter 109 is provided, the hearing aid controller 103 may also make a control to store data input from the second analog-to-digital converter 109 in the hearing aid memory 108.

The third control operation of the hearing aid controller 103 is to control the hearing aid wireless unit 106. The operation of controlling the hearing aid wireless unit 106 may be divided into two cases.

One is a case in which the hearing aid controller 103 operates passively. The hearing aid controller 103, when operating passively, receives a specific command from the outside of the hearing aid through the hearing aid wireless unit 106 and executes the corresponding received command. For example, in order to check a state of the hearing aid, a user may request currently stored data from the hearing aid using an electronic device. Then, the hearing aid controller 103 may receive a specific command from the electronic device through the hearing aid wireless unit 106. The hearing aid controller 103 may check the received command to perform an operation corresponding to the command. That is, the hearing aid controller 103 may make a control to read the output value of the first analog-to-digital converter 102 and the output value of the digital data amplified by the hearing aid controller 103 out of the hearing aid memory 108, convert the output values into data for transmission, and transmit the converted data to the corresponding electronic device through the hearing aid wireless unit 106. At this time, the hearing aid controller 103 may also make a control to provide feedback data to the electronic device through the hearing aid wireless unit 106, if desirable, the feedback data being input from the second analog-to-digital converter 109 and stored in the hearing aid memory 108. This may lead the hard of hearing who wear a hearing aid or a checker who wants to check a hearing aid to easily detect a state of the hearing aid or/and a change in hearing of the wearer through the electronic device.

The other is a case in which the hearing aid controller 103 operates actively. An active check made by the hearing aid controller 103 may be divided into two main checks. One is a check on an amplification factor, and the other is a check on feedback.

The check on the amplification factor will be first described. The check on the amplification factor corresponds to a check as to whether an input signal or data is amplified according to a pre-configured amplification factor.

The hearing aid controller 103 may make a check on an amplification factor using input digital data and output digital data at a pre-configured period, continuously, or in a specific case configured in advance. The output digital data is obtained by amplifying the input digital data. Accordingly, a process of checking the amplification factor may be an operation of checking whether the amplification factor is the same as a pre-configured amplification factor, by processing one of the two pieces of data and then comparing them. This may lead the hearing aid controller 103 to compare the input data and the output data using amplification factor data previously stored in the hearing aid memory 108 to thereby check whether the input data has been amplified as much as desired. When the amplification factor is beyond a predetermined threshold (margin) of an error in the check on the amplification factor, the hearing aid controller 103 may determine abnormality of the hearing aid. Here, likewise to the amplification factor, the error range may be configured through a hospital or a hearing aid shop, or may also be configured in advance when the product is manufactured. The amplification factor of the hearing aid and the error check according to the amplification factor will be described in more detail with reference to the accompanying drawings.

When the abnormality of the hearing aid is detected as described above, the hearing aid controller 103 may control the hearing aid wireless unit 106 to transmit information on the abnormality of the hearing aid to a previously registered electronic device. This may lead the hearing aid wearer to identify the abnormality of the hearing aid.

Next, the check on feedback will be described. The feedback check uses data fed back to the hearing aid controller 103 from the second analog-to-digital converter 109. The feedback check may also be divided into two types of checks.

In the first feedback check, a check may be made as to whether the digital-to-analog converter 104 and the second filter 105 operate normally, and in the second feedback check, a check may be made as to whether an output of the speaker (SPK) is normal.

The first feedback check will be described. The hearing aid controller 103 may compare input data with feedback data using amplification factor data previously stored in the hearing aid memory 108 to check whether amplified data is normally output. The check may be made in the same method as comparing output data and input data. In a different method, the hearing aid controller 103 may also check abnormality of feedback data, by checking whether a difference between amplified data and the feedback data is within a range of a pre-configured margin. Through the first feedback check, the hearing aid controller 103 may check whether amplified data is lost in an output route or there is abnormality in processing the amplified data. In the following description, data for the first feedback check is referred to as first feedback data.

Next, the second feedback check will be described. The second feedback check is to detect abnormality of the speaker (SPK). The second filter 105 receives an electrical voice signal from a sub-microphone (Sub_MIC), and the electrical voice signal is fed back to the hearing aid controller 103 from the second filter 105 through the second analog-to-digital converter 109. In the following description, the electrical voice signal fed back to the hearing aid controller 103 is referred to as second feedback data. Here, likewise to the amplification factor, an error range may be configured through a hospital or a hearing aid shop, or may also be configured in advance when the product is manufactured.

The hearing aid controller 103 may perform the two main checks as described above, in which case the checks may be made independently or together.

Furthermore, in the following description, the first feedback data and the second feedback data will be differently described when it is beneficial to differently describe the first feedback data and the second feedback data. In other cases, feedback data or feedback characteristic data may be the first feedback data or/and the second feedback data.

In the above-described checks on the amplification factor and the feedback, there may be some temporal errors in signal processing. Accordingly, the hearing aid controller 103 has to make the checks in view of the temporal errors.

For example, the hearing aid controller 103, when receiving a voice feedback signal from the second analog-to-digital converter 109, may compare the voice feedback signal with a voice output signal previously stored in the hearing aid memory 108. Here, provided that a current time point is t, the voice output signal previously stored in the hearing aid memory 108 may be a signal output from the hearing aid controller 103 at a time point of t-n. The time point of t-n may be time when the signal is amplified by the hearing aid controller 103 and input via the digital-to-analog converter 104, the second filter 105, the speaker (SPK), the sub-microphone (Sub_MIC), and the second analog-to-digital converter 109. That is, the hearing aid controller 103 may calculate in advance time taken for the aforementioned process, store data corresponding to the calculated time in the hearing aid memory 108, and then calculate a value input from the second analog-to-digital converter 109 and a value currently input from the hearing aid controller 103. The hearing aid controller 103 may compensate for the time calculated as described above to compare input data with output data.

The hearing aid controller 103 may control the hearing aid wireless unit 106 to transfer the above-described check results to a pre-configured electronic device for the hearing aid. This may lead to providing a user with an alarm.

Meanwhile, the hearing aid controller 103 may not make the above-described checks, and the hearing aid memory 108 may not have areas for storing input data, output data, and feedback data. In this case, the hearing aid controller 103 may control the hearing aid wireless unit 106 in units of pre-configured time intervals or continuously to transfer the input data, the output data, and the feedback data to an electronic device registered in advance.

The fourth control operation of the hearing aid controller 103 is to control an alarm. The hearing aid controller 103 may check continuously or at a pre-configured period whether an amplification factor between an input digital signal and an amplified output signal corresponds to a pre-configured amplification factor. Such a check may also be included in the above-described active control. When there is abnormality in the hearing aid, the hearing aid controller 103 may inform a hearing aid wearer of the abnormality of the hearing aid through the alarm indication unit 107 provided to the hearing aid.

Meanwhile, the digital-to-analog converter 104 may convert digital data amplified by the hearing aid controller 103 into an analog signal. The converted analog signal may be an electrical sound signal amplified to solve hearing loss of a hearing aid wearer.

The second filter 105 receives the amplified electrical audio signal, removes noise, having occurred in the amplification operation, the analog-to-digital conversion operation, and the digital-to-analog conversion operation, from it, and then outputs the noise-removed electrical audio signal. The electrical signal from which the noise has been removed by the second filter 105 may be output as an audio signal for the hearing aid wearer through the speaker (SPK). In some cases, without the second filter 105, the signal output from the digital-to-analog converter 104 may also be directly output as an audio signal through the speaker (SPK). Furthermore, some of the electrical audio signal output from the second filter 105 may be input to the second analog-to-digital converter 109. Moreover, when the second filter 105 is not included, some of the electrical audio signal output from the digital-to-analog converter 104 may also be input to the second analog-to-digital converter 109. For convenience of description, the following description is made under the assumption that the second filter 105 is included.

The hearing aid wireless unit 106 may be a module for performing wireless communication between the hearing aid and another electronic device in a pre-configured manner. For example, the hearing aid wireless unit 106 may perform the wireless communication through the Bluetooth communication scheme or the Wi-Fi communication scheme, and a target device for the wireless communication may be another electronic device previously registered by a user. Although the Bluetooth communication scheme or the Wi-Fi communication scheme has been described as an example of the wireless communication scheme in the embodiment of the present invention, any other communication scheme may be used.

The alarm indication unit 107 may be various types of devices for visually displaying an alarm, such as a lamp, a liquid crystal display panel, a Light Emitting Diode (LED), and the like. The alarm indication unit 107 may also be an indication device for providing auditory, olfactory, or tactile effects. The hearing aid is an apparatus generally used by the deaf. Accordingly, the alarm indication unit 107 may be configured with a device for providing auditory or tactile effects rather than visual effects. For example, in case of abnormality in the hearing aid, the alarm indication unit 107 may provide a pre-configured alarm sound or use such a method as vibration, etc.

The second analog-to-digital converter 109 may convert the analog signal output from the second filter 105 into digital data again. The digital data converted by the second analog-to-digital converter 109 may be provided to the hearing aid controller 103. This may lead the hearing aid controller 103 to identify where a malfunction arises in the entire configurations of the hearing aid when the hearing aid malfunctions. Furthermore, the output from the second analog-to-digital converter 109 may be feedback characteristic data.

The user input unit 110 is an interface through which a user instructs a stopping of an alarm, or a specific operation. The user input unit 110 may be configured with a key input unit, a touch pad, or/and an external device interface, and may provide a user's request signal to the hearing aid controller 103.

The characteristic data has also been briefly described above. In the following description, characteristic data may be a general term for all of the input characteristic data, the amplified characteristic data, and the feedback characteristic data which have been described above, and may also refer to some of them.

Figure 2:
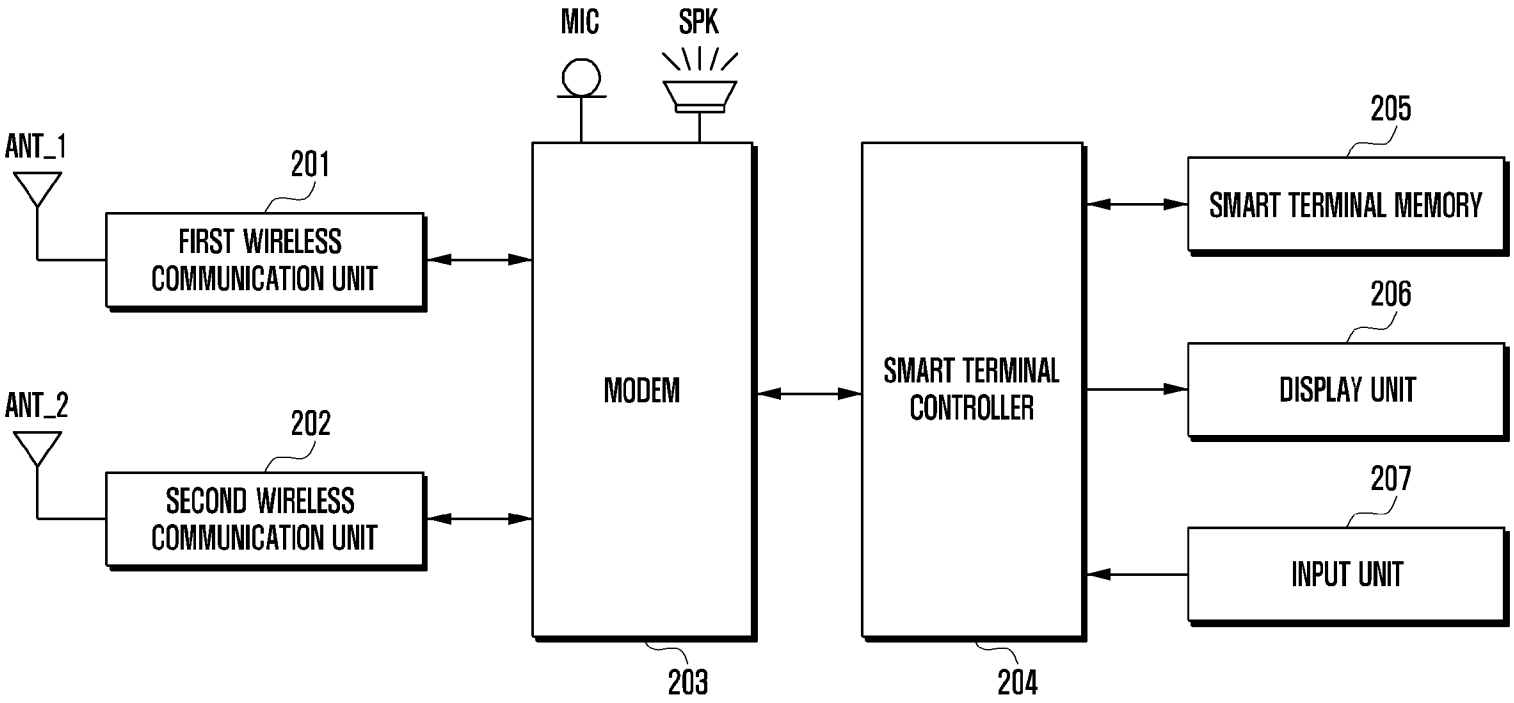
FIG. 2 is a block diagram of an example smart terminal to which the present invention is applied.

FIG. 2 is a block diagram of an example smart terminal to which the present invention is applied.

The smart terminal has a first antenna ANT_1 that can communicate with a mobile communication network and a second antenna ANT_2 that can communicate with a hearing aid, and the respective antennas ANT_1 and ANT_2 may be connected with first and second wireless communication units 201 and 202 to transmit/receive data.

A wireless signal processor capable of communicating with a specific wireless network such as a mobile communication network, the first wireless communication unit 201 up-converts data, which will be transmitted for voice communication or/and data communication, to a band used in the corresponding network, and down-converts a signal received from the corresponding network. That is, the first wireless communication unit 201 up-converts a signal in the baseband to a band of the corresponding network for voice or data communication to transmit the up-converted signal to the corresponding network through the first antenna ANT_1, and receives a wireless signal from the corresponding network through the first antenna ANT_1 to down-convert the received wireless signal so as to convert it into a signal in the baseband. The operation of the first wireless communication unit 201 may vary depending on the mobile communication network to which the smart terminal belongs.

The following description will be made under the assumption that the second wireless communication unit 202 may perform wireless communication with the hearing aid. The second wireless communication unit 202 up-converts data, which will be transmitted to the hearing aid, to a pre-configured band, and down-converts a signal received from the hearing aid. That is, the second wireless communication unit 202 up-converts a signal in the baseband to a pre-configured type of wireless band for data transmission to transmit the up-converted signal to the hearing aid through the second antenna ANT_2, and receives a wireless signal in the pre-configured type of wireless band from the hearing aid through the second antenna ANT_2 to down-convert the received wireless signal so as to convert it into a signal in the baseband. The operation of the second wireless communication unit 202 is not limited to the above-described protocol, and may vary depending on the method of communicating with the hearing aid wireless unit 106.

A modem 203 performs a series of data processings such as modulation, demodulation, encoding, and decoding of transmitted/received data. Since it is assumed that the general smart terminal is exemplified in FIG. 2, the modem 203 may include a vocoder for performing modulation, demodulation, encoding, and decoding of a voice signal. The modem 203 receives an electrical voice signal from a microphone (MIC), and converts the received voice signal to a digital voice signal. Furthermore, the modem 203 may convert a digital voice signal into an electrical voice signal and output the electrical voice signal through a speaker (SPK). Moreover, the modem 203 performs a series of operations such as modulation, demodulation, encoding, and decoding of other used data under the control of a smart terminal controller 204. In the present invention, an audio processor is the general term for the microphone (MIC), the speaker (SPK), and the modem 203.

The smart terminal controller 204 may control overall operations of the smart terminal, and in particular, may perform a control to check abnormality in an amplification factor and an output path of the hearing aid. The smart terminal controller 204 may diagnose a state of the hearing aid using a hearing aid diagnostic program stored in advance therein. To this end, the smart terminal controller 204 may perform a control to create a command to read data out of the hearing aid and provide the hearing aid with the command. Furthermore, the smart terminal controller 204 may make a check as to whether amplification is normally performed depending on the amplification factor first configured in the hearing aid, using the data received from the hearing aid, and may detect whether there is abnormality on a signal path in the hearing aid. The smart terminal controller 204 may control a display unit 206 to display results obtained by making the check. The control operation for checking the state of the hearing aid and the control operation for displaying the check results will be described below in more detail with the accompanying flowcharts.

A smart terminal memory 205, which is a storage medium such as a Read Only Memory (ROM) or/and a Random Access Memory (RAM), may store a variety of types of control data utilized for the operations of the smart terminal. The smart terminal memory 205 may store control data for communication with the hearing aid and control data for a check on the state of the hearing aid. Furthermore, the smart terminal memory 205 may store amplification factor data configured for the hearing aid, and may have a separate memory for simulating an operation of the hearing aid. In addition, the smart terminal memory 205 may include areas for storing user data.

The display module 206 may be configured in the form of an LCD or LED panel, and may display processes utilized for an operation of the smart terminal and a status of the smart terminal in a standby state under the control of the smart terminal controller 204.

An input unit 207 may be configured with a sensor for sensing a user's touch input and a key button for a key input. The input unit 207 may receive a signal for the user's touch input or/and a signal for the key input to provide them to the smart terminal controller 204.

The smart terminal has been described above as an example of the electronic device. The electronic device according to various embodiments of the present invention may be a desktop Personal Computer (PC), a laptop PC, a Personal Digital Assistant (PDA), a Portable Multimedia Player (PMP), a tablet PC, a mobile phone, a video phone, a feature phone, a smart phone, an electronic book reader, a digital camera, a wearable device, a wireless device, a Global Positioning System (GPS) system, a hand-held device, an MP3 player, a camcorder, a game console, an electronic watch, a flat panel device, an electronic photograph, an electronic board, an electronic sign board, a projector, a navigation device, a black box, a set-top box, an electronic dictionary, a refrigerator, an air conditioner, a vacuum cleaner, an artificial intelligence robot, a TeleVision (TV), Digital Versatile Disk (DVD) player, a stereo, an oven, a microwave oven, a washing machine, an air cleaner, a medical device, a vehicle device, a shipbuilding device, an aircraft device, a security device, agricultural, livestock, and fishery equipment, electronic clothing, an electronic key, an electronic bracelet, or an electronic necklace. For example, the electronic devices may be driven by various operating systems, such as Android, iOS, Windows, Linux, Symbian, Tizen, and Bada. It is apparent to those skilled in the art that the electronic device and the operating system according to various embodiments of the present invention are not limited to the above described examples.

In one embodiment of the present invention, a hearing aid itself makes a check on characteristics thereof to determine and inform of abnormality thereof. Then, the embodiment will be described with reference to the accompanying drawings.

Figure 3:
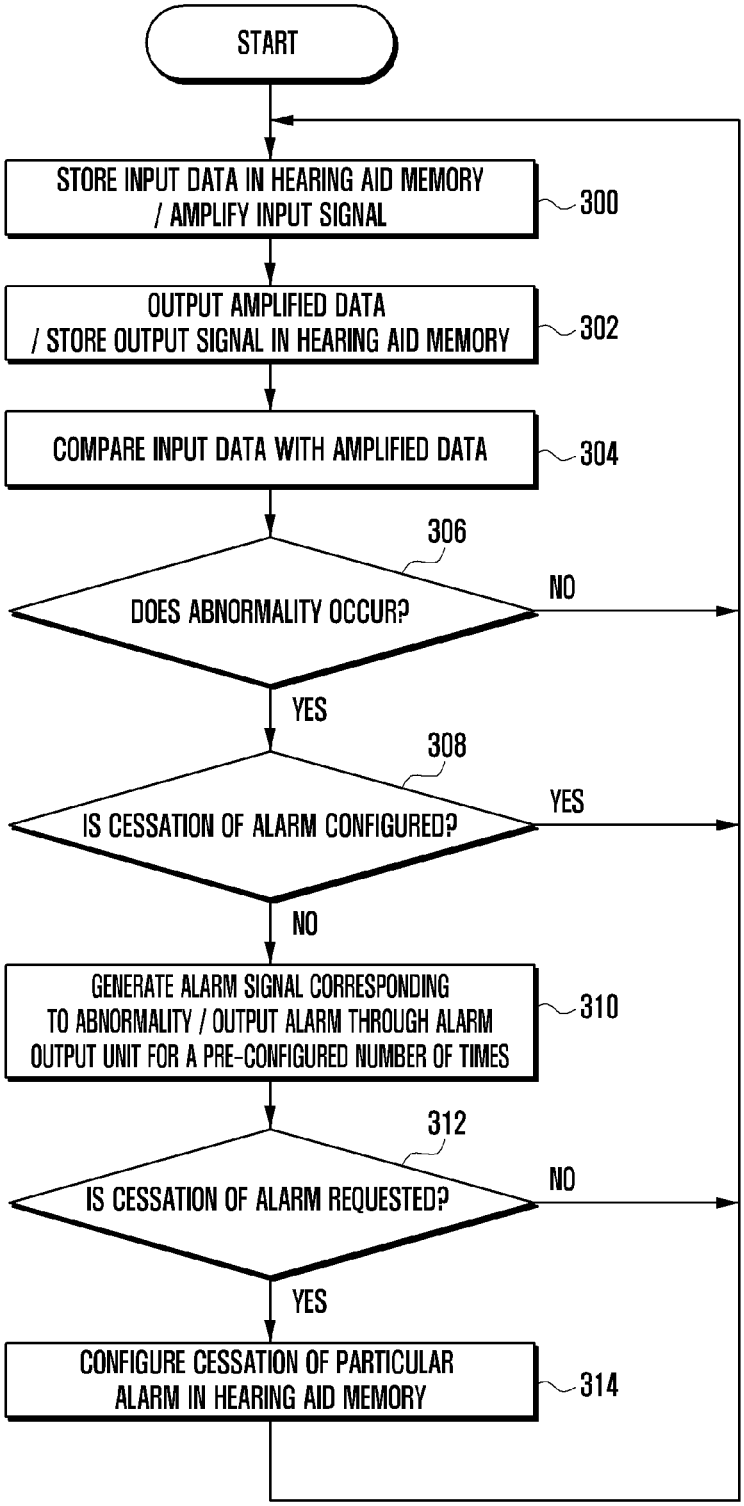
FIG. 3 is a flowchart illustrating an example process of checking characteristics of a hearing aid to determine abnormality thereof according to one embodiment of the present invention.

FIG. 3 is a flowchart illustrating an example process of checking characteristics of a hearing aid to determine abnormality thereof according to one embodiment of the present invention.

In the embodiment illustrated in FIG. 3, the hearing aid itself performs a check on amplification characteristics thereof and detects any abnormalitiesy to inform a hearing aid wearer of the abnormality.

Referring to FIG. 3, in operation 300, a hearing aid controller 103 stores received input characteristic data in a hearing aid memory 108, and amplifies the input characteristic data by a pre-configured value. Here, the input characteristic data received by the hearing aid controller 103 may be an analog signal obtained through a microphone MIC, that has passed through a first filter 101 and then converted into a digital signal by a first analog-to-digital converter 102, as described previously with reference to FIG. 1. Furthermore, the hearing aid controller 103 may execute amplification based on amplification factors stored in the hearing aid memory 108. The amplification factors stored in the hearing aid memory 108 may be amplification factors according to specific frequencies, pre-configured bands, or pre-configured channels for input digital data. Here, the amplification factors may differ with regard to the specific frequencies, the pre-configured bands, or the pre-configured channels of each particular factor.

In operation 302, the hearing aid controller 103 may output amplified output characteristic data to a digital-to-analog converter 104 and simultaneously store it in the hearing aid memory 108. The output characteristic data transmitted to the digital-to-analog converter 104 may be filtered through a second filter 105 before output through a speaker (SPK). The signal output through the speaker (SPK) in this way may be an acoustic signal of the audio frequency band that has been amplified as to be suitable for a hearing aid wearer.

The hearing aid memory 108 may have an area storing the input characteristic data and an area storing the output characteristic data, and the input data and the output data may be stored in a matching format. That is, input characteristic data entered at a time point of t and input characteristic data entered at a time point of t+1 may be stored in different locations. In other words, the hearing aid memory 108 may have separate memory locations to store input data according to time points when the input data is entered.

Output characteristic data obtained by amplifying the input characteristic data entered at the time point of t may be stored in a storage location which may be matched with the input time point of t, and output characteristic data obtained by amplifying the input characteristic data entered at the time point of t+1 may be stored in a storage location which may be matched with the input time point of t+1. That is, the hearing aid controller 103 may store the input and output characteristic detain matching formats and according to the time t or t+1 at which they were received.

Furthermore, the hearing aid controller 103 may perform an operation of storing feedback characteristic data in the hearing aid memory 108 together with the above-described operations. That is, after amplifying and outputting the input characteristic data entered at the time point of t, the hearing aid controller 103 may receive feedback characteristic data relating to sound fed back through a second analog-to-digital converter 109, which correlate to the signals output through the digital-to-analog converter 104 and the second filter 105. The received feedback characteristic data may be stored in the hearing aid memory 108. Even in this case, feedback characteristic data corresponding to the input characteristic data at the time point of t may be stored in the hearing aid memory 108 in a format enabling the feedback characteristic data to be matched with the input characteristic data at the time point of t, and feedback characteristic data corresponding to the input characteristic data at the time point of t+1 may be stored in the hearing aid memory 108 in a format in which the feedback characteristic data may be matched with the input characteristic data at the time point of t+1. Accordingly, the hearing aid memory 108 may store three pieces of data for the specific time point of t:

1. Input characteristic data at the time point of t;
2. Output characteristic data corresponding to the input characteristic data at the time point of t; and
3. Feedback characteristic data corresponding to the input characteristic data at the time point of t.

All of the three pieces of data may be stored in the hearing aid memory 108, or one of the output characteristic data and the feedback characteristic data may be stored in the hearing aid memory 108, while being matched with the input characteristic data. Furthermore, the output characteristic data and the feedback characteristic data may also be stored in the hearing aid memory 108.

In operation 304, the hearing aid controller 103 may read data at the same time points of the characteristic data stored in the hearing aid memory 108 to check whether the amplified data is within a predetermined threshold of an amplification factor. As described above, such a check may be made in units of pre-configured time intervals, continuously while the hearing aid operates, or when data of a pre-configured band is input.

Figure 4A:
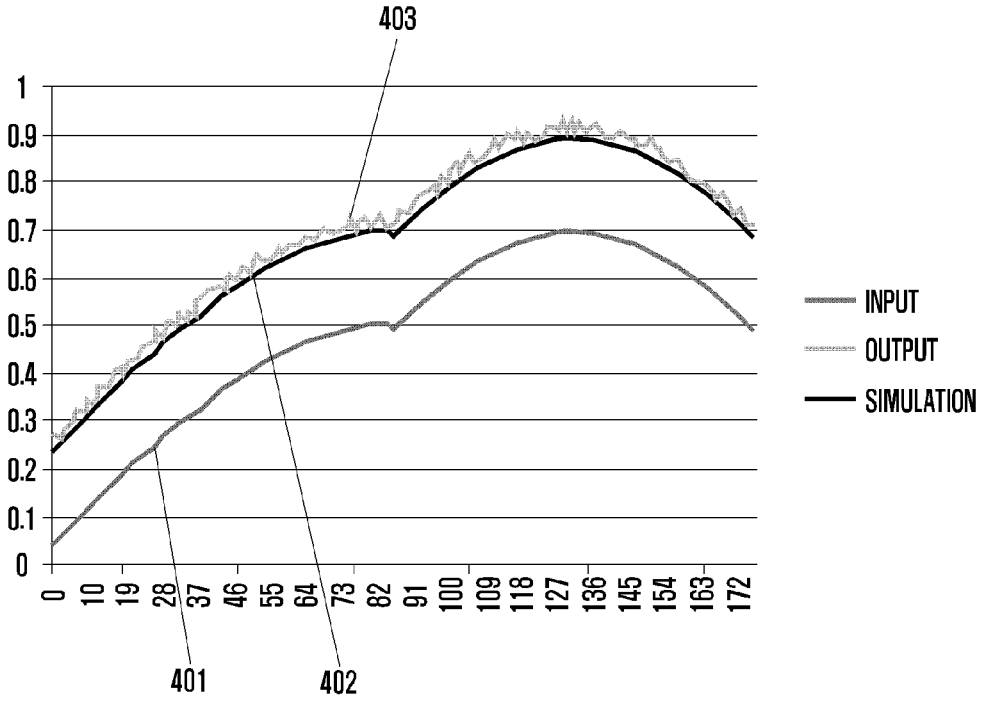
FIG. 4A illustrates examples of simulation using input characteristic data and output characteristic data to describe the present invention.
Figure 4B:
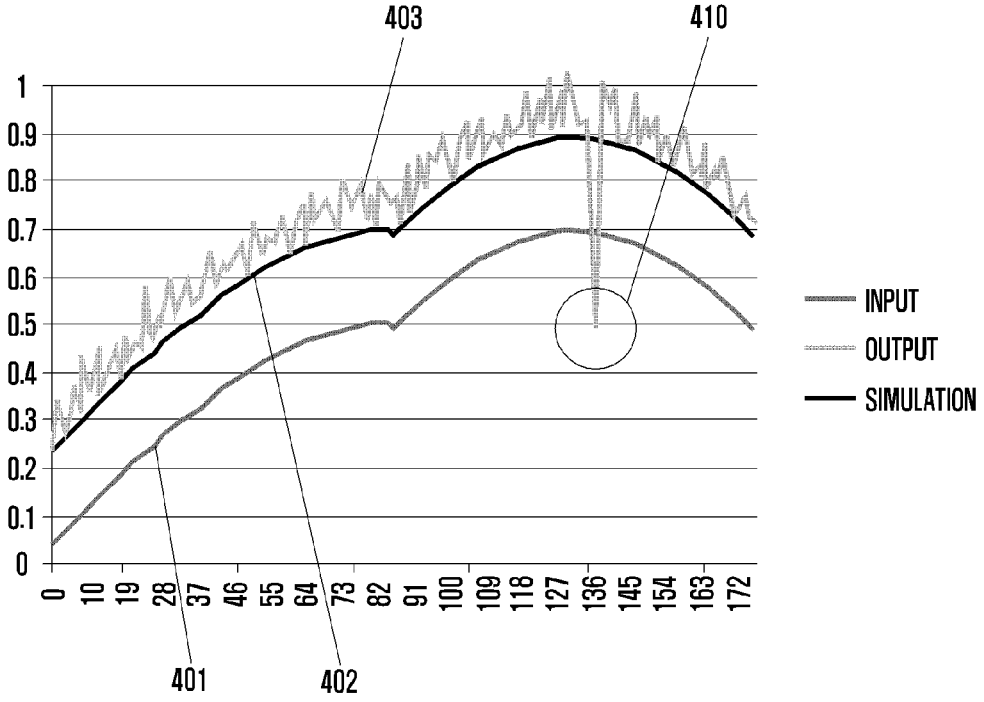
FIG. 4B illustrates examples of simulation using input characteristic data and output characteristic data to describe the present invention.

FIGS. 4A and 4B illustrate examples of simulation using input characteristic data and output characteristic data to describe the present invention.

In the examples illustrated in FIGS. 4A and 4B, reference numeral 401 denotes a graph of input characteristic data, reference numeral 402 denotes a graph of a simulation result, and reference numeral 403 denotes a graph of output characteristic data or feedback characteristic data. Hereinafter, for convenience of description, reference numeral 403 is assumed to denote the output characteristic data. However, it should be noted that a check may also be made in the same manner for the feedback characteristic data.

In FIG. 4A, the graph 403 of the output characteristic data shows that the output characteristic data is normally amplified and output according to a predetermined amplification factor. That is, the graph 401 of the input characteristic data and the graph 403 of the amplified output characteristic data are within an allowable range of the graph 402 of the simulation result. However, in FIG. 4B, denoted by reference numeral 410, a portion of the graph 403 of the output characteristic data is beyond the allowable range of the graph 402 of the simulation result. The allowable error range in the graph 402 of the simulation result is a value, such as a margin of +/−5% or +/−10%, which can be configured in advance.

As described above, in operation 304, the hearing aid controller 103 may compare the input characteristic data and the amplified output characteristic data with the allowable range of the simulation result obtained by a pre-configured program or that of the previously stored simulation result.

Thereafter, in operation 306, the hearing aid controller 103 may determine whether there is abnormality in the comparison result between the simulation result and the output characteristic data or/and between the simulation result and the feedback characteristic data. That is, the hearing aid controller 103 may determine whether there is some output characteristic data or/and feedback characteristic data beyond the allowable range of the margin as illustrated in FIG. 4B.

The hearing aid controller 103 may proceed to operation 308 when determining in operation 306 that the abnormality has occurred, and may return to operation 300 when determining in operation 306 that there is no abnormality. In operation 308, the hearing aid controller 103 may inspect the hearing aid memory 108 to determine whether an alarm has been configured to be disabled. When the inspection result for the hearing aid memory 108 shows that the currently occurred alarm is disabled, the hearing aid controller 103 may return to operation 300, and if not, may proceed to operation 310.

When proceeding to operation 310, the hearing aid controller 103 may make a control to generate an alarm signal corresponding to the currently occurred abnormality and output it through an alarm indication unit 107. The alarm may repeat a pre-configured number of times. While the alarm is being output for the pre-configured number of times, the hearing aid controller 103 may determine whether a request for stopping the alarm is received in operation 312. That is, the hearing aid controller 103 may determine whether a configuration is requested through a user input unit 110 indicating desired cessation of the currently active. When it is determined in operation 312 that a user does not want the continued alarm, that is, when the operation flow proceeds to operation 314 from operation 312, the hearing aid controller 103 may set the hearing aid memory 108 to cease generation of additional notification signals for the, and may control the alarm indication unit 107 to stop outputting the alarm.

An alarm output and a ban on the alarm output will be described with reference to one example embodiment. It is assumed that various type of errors that may arise in the hearing aid have been previously stored as a list, and there are messages to output through the alarm indication unit 107 for the respective errors.

The hearing aid controller 103, when detecting an abnormality caused by a problem with an amplification factor or abnormality in an output line, may control the alarm indication unit 107 to provide an alarm with a voice, a sound, or/and vibration. In this case, the hearing aid controller 103 may check whether a cessation of the corresponding alarm has been configured in the hearing aid memory 108. Such a check may correspond to situations where the hearing aid wearer has already configured a cessation of the same alarm when it occurred in the past. Accordingly, the hearing aid controller 103 may determine whether via the check whether the same situation occurred before and thereby detect the configured previous cessation of the corresponding alarm in the hearing aid memory 108. This is because repeated activation of the same particular alarm may be annoying and unneeded for the wearer when the hearing aid wearer recognizes the abnormality in the hearing aid 100, and is repairing the hearing aid or doing some other activity that they know will trigger the alarm. Thus, when the wearer has preconfigured the hearing aid such that further instances of the same particular alarms for the same alarm situation do not cause the particular alarm to be triggered.

In contrast, if the same alarm did not occur before, or the hearing aid wearer did not preconfigure a cessation of the alarm, the hearing aid controller 103 may control the alarm indication unit 107 to provide an alarm corresponding to the occurred alarm. When there is a problem with the hearing aid, the hearing aid controller may make the hearing aid wearer continuously informed or not informed of the problem with the hearing aid, and this may help the hearing aid wearer not suffer from the alarm.

Meanwhile, even while outputting the alarm in the alarm situation, the hearing aid controller 103 may continuously perform operations 300 and 302. Furthermore, when operation 304 is performed, the hearing aid controller 103 may also continuously perform operation 304. In contrast, if operation 304 is performed at a pre-configured period or when particular abnormality occurs, the hearing aid controller 103 may not perform operation 304 while performing operation 310.

In the above-described embodiment of FIG. 3, the amplification characteristics of the hearing aid have been described. However, even when using feedback data, that is, checking the state of blocks or/and a speaker (SPK) located on an output line of the hearing aid 100, the hearing aid controller 103 may make the check in such a format as illustrated in FIG. 3. For example, the hearing aid controller 103 may perform operations 300 and 302 in the same manner, and thereafter, instead of operation 304, may perform an operation of receiving feedback data and comparing the received feedback data with input data. That is, the hearing aid controller 103 may determine whether a difference between the input data and the feedback data is larger than a pre-configured threshold value. Such a determination as described above may correspond to operation 306 of identifying whether there is abnormality.

Comparing the first feedback data with input data or amplified data may correspond to making a detecting whether the digital-to-analog converter 104 and the second filter 105 are operating normally. Comparing the first feedback data to the amplified data may be conducted by amplifying the first feedback data by the same amplification factor as used in the previous amplification of the input characteristic data and then comparing the newly amplified data with the previously amplified data. Alternatively, by attenuating the amplified data by a reciprocal of the amplification factor and then executing the comparison, the comparison between the first feedback data and the amplified data can be made at the same level.

Comparing second feedback data with input data or amplified data may correspond to detecting to whether the speaker (SPK) is operating normally. If the second feedback data is compared with the amplified data, by amplifying the second feedback data by the same amplification factor as that used in the amplification of the input characteristic data and then comparing them, or by attenuating the amplified data by a reciprocal of the amplification factor and then comparing them, the comparison between the second feedback data and the amplified data can be made at the same level.

Even when the feedback data is used as described above, the operations illustrated in the flowchart of FIG. 3 may be applied as they are.

In another embodiment of the present invention, a hearing aid actively recognizes an alarm situation and notifies a preconfigured electronic device, for example, a smart terminal of the alarm situation.

Figure 5:
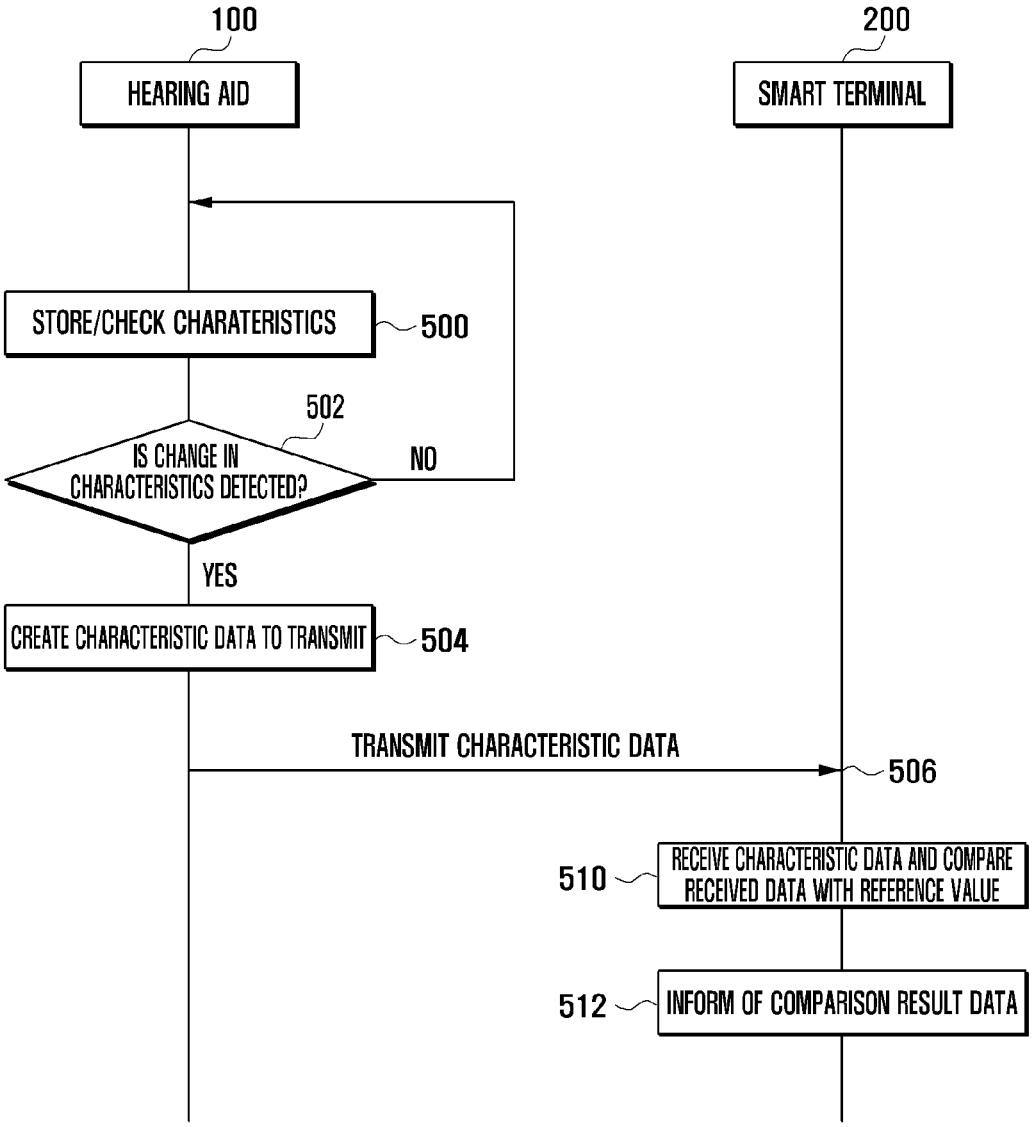
FIG. 5 is a signal flow diagram illustrating an example process in which a hearing aid recognizes an alarm situation and informs a smart terminal of the alarm situation according to one embodiment of the present invention.

FIG. 5 is a signal flow diagram illustrating an example process in which the hearing aid recognizes the alarm situation and informs a smart terminal of the alarm situation according to one embodiment of the present invention.

A hearing aid 100 is assumed to store in a hearing aid memory 108 characteristics related to amplification and characteristics related to operations of internal devices. In this situation, a hearing aid controller 103 may receive input characteristic data (e.g., an input audio signal), output characteristic data (e.g., an output audio signal), and feedback characteristic data (e.g., a third audio signal related to feedback of the output audio signal) and store them in the hearing aid memory 108 in operation 500. Furthermore, the hearing aid controller 103 may monitor inputs, outputs and feedback of the hearing aid in predetermined time intervals or in a continuous manner. The monitoring may be executed in the same way as illustrated in FIGS. 4A and 4B.

When monitoring the characteristics, the hearing aid controller 103 may proceed to operation 502 to determine whether the hearing aid 100 is experiencing a characteristic value departing from an allowable range as denoted by reference numeral 410 of FIG. 4B indicating, for example, feedback above a tolerable quantity of feedback. The hearing aid controller 103 may proceed to operation 504 when it is determined in operation 502 that the change in the characteristics has been detected, and may return to operation 500 when it is determined that the change in the characteristics has not been detected.

When proceeding to operation 504, the hearing aid controller 103 creates data corresponding to the changed characteristics and the result data in a format for transmission to a smart terminal 200 and transmits the created data to the smart terminal 200 in operation 506.

When the hearing aid 100 creates the characteristic data to transmit in operation 504 and transfer the created data to the smart terminal 200 through a predetermined channel in operation 506, the smart terminal 200 may receive it in operation 510. In the smart terminal 200, a second wireless communication unit 202 may convert the received signal into a signal in the baseband, and a modem 203 may demodulate and decode the converted signal to provide it to a smart terminal controller 204. Then, the smart terminal controller 204 may compare the received characteristic data with a reference value previously stored in a smart terminal memory 205 or a reference value obtained by simulation of a preconfigured program again. That is, as illustrated in FIGS. 4A and 4B, the smart terminal controller 204 may make a check by comparing the simulation value with the input value and the output value once again. Through the comparison, the smart terminal controller 204 may identify again whether an alarm provided by the hearing aid 100 is an accurate alarm.

Thereafter, the smart terminal controller 204 may display the result of the alarm states on a display unit 206. At this time, the smart terminal controller 204 may display it in message form on the display unit 206, or may provide it in a form of a message, a graph as illustrated in FIG. 4B, vibration, or/and a scent to inform a user of the current state of the hearing aid.

In another example, the smart terminal 200 may also be configured not to perform operation 510. For example, the hearing aid 100 may be configured to transmit the alarm information on the occurred error together with the characteristic data, and the smart terminal controller 204 may be configured to display the received data itself to a user. In this case, the smart terminal controller 204 may control the display unit 206 to display the characteristic data and the check result thereof provided from the hearing aid 100, for example, the state information on the occurred abnormality. At this time, the smart terminal controller 204 may control the display unit 206 to display the characteristic data and the check result thereof in a message form, or may provide them in a form of a message, a graph as illustrated in FIG. 4B, vibration, or/and a scent to inform the user of the current state of the hearing aid.

In yet another embodiment according to the present invention, when a user wants to identify a state of a hearing aid 100 using a smart terminal 200, the user may request the current status of the hearing aid 100 through the smart terminal 200, and the hearing aid 100 may accordingly create characteristic data to provide to the smart terminal 200. Then, the smart terminal 200 may detect the state of the hearing aid 100 using the received characteristic data and thereafter, informs the user whether there is any abnormality in the hearing aid.

Figure 6:
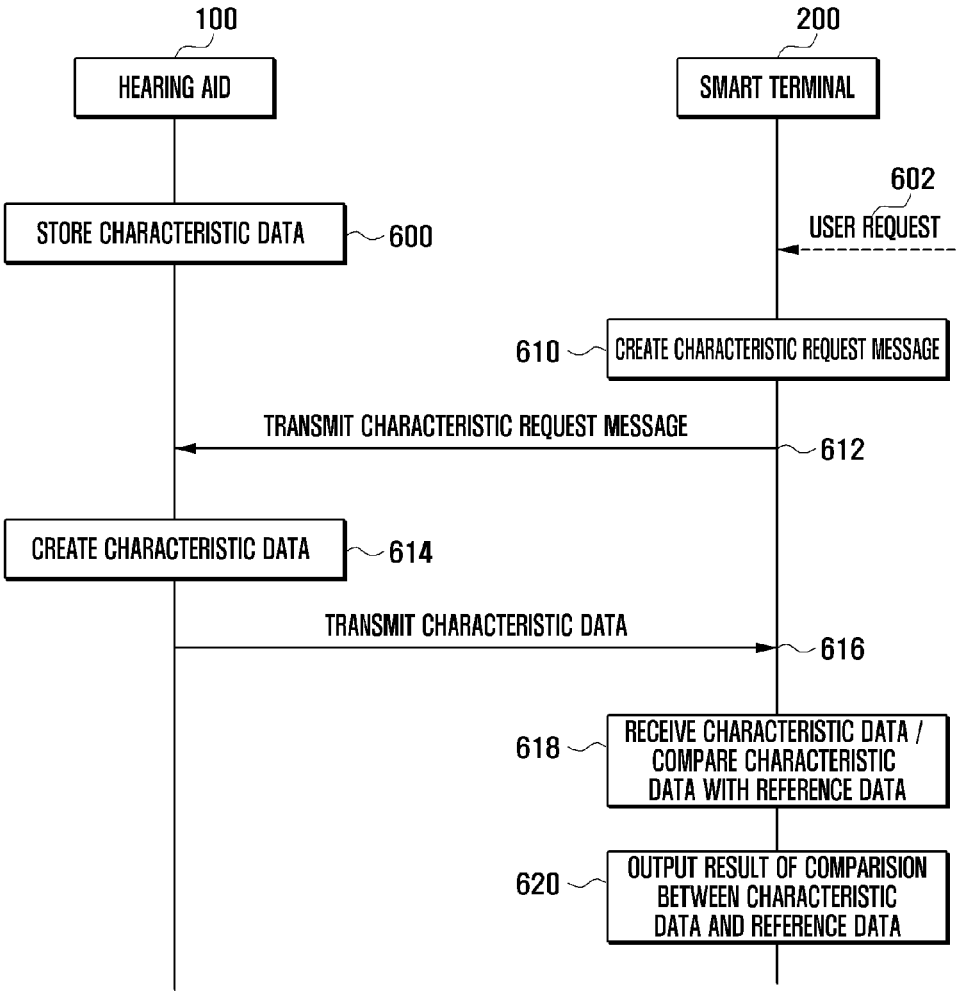
FIG. 6 is a signal flow diagram illustrating an example process of checking characteristics of a hearing aid using a smart terminal according to one embodiment of the present invention.

FIG. 6 is a signal flow diagram illustrating an example process of detecting a status of and receiving characteristics of a hearing aid using a smart terminal according to one embodiment of the present invention.

In operation 600, the hearing aid 100 may continuously store characteristic data. That is, as described above, the hearing aid 100 may create input characteristic data, output characteristic data, and feedback characteristic data in matching formats, and continuously store them in a hearing aid memory 108 moment by moment. In this way, the hearing aid 100 may store the characteristic data, created by a hearing aid controller 103.

Meanwhile, when the user makes a request for checking the state of the hearing aid 100 in operation 602, the smart terminal 200 may proceed to operation 610 to create a characteristic request message to request transmission of characteristic data from the hearing aid 100, and in operation 612, may transmit the characteristic request message to the hearing aid 100. That is, when receiving a command to detect the state of the hearing aid 100 from the user through an input unit 207, a smart terminal controller 204 may create the characteristic request message in operation 610 and control a modem 203 and a second wireless communication unit 202 to transmit the request to the hearing aid 100. Then, in response, the second wireless communication unit 202 may transmit the characteristic request message to the hearing aid 100 using a wireless band configured for communication with the hearing aid 100 in operation 612.

The smart terminal controller 204 may control a microphone (MIC) of the smart terminal 200 and the modem 203 to extract the same signal input to the hearing aid 100 in order to detect abnormality in input data of the hearing aid 100. For example, the smart terminal controller 204 may simulate the same data as the input data of the hearing aid. The input data simulated by the smart terminal 200 in this way may be compared with the input data of the characteristic data provided from the hearing aid 100, and this may lead the smart terminal controller 204 to detect a problem with an input line including a microphone (MIC) of the hearing aid 100.

More specifically, the hearing aid controller 103 of the hearing aid 100 may receive an input of data, received from the microphone (MIC) at a specific time point of t, through a first filter 101 and a first analog-to-digital converter 102. Furthermore, the smart terminal controller 204 of the smart terminal 200 may be provided with the data, input to the microphone (MIC), through the modem 203. At this time, the data received by the hearing aid controller 103 corresponds to input characteristic data. Furthermore, the data input to the smart terminal 200 through the modem 203 may correspond to input data to be used for a comparison with the input characteristic data. The smart terminal controller 204 may compare the input characteristic data received from the hearing aid 100 with the data acquired by the smart terminal 200 to detect the abnormality in the input line including the microphone (MIC) of the hearing aid 100. At this time, since the location of the microphone (MIC) of the hearing aid 100 may not be identical to that of the microphone (MIC) of the smart terminal 200, and reception characteristics thereof may be different from each other, the smart terminal controller 204 may allow for a certain amount of predetermined error.

Referring back to FIG. 6, when the hearing aid 100 receives the characteristic request message through the above-described process, the hearing aid controller 103 may read the characteristic data stored in the hearing aid memory 108, namely, the input characteristic data, the output characteristic data, and the feedback characteristic data, and may process the characteristic data into a format for transmission. The characteristic data may be processed according to a pre-configured communication scheme.

After processing the characteristic data into the format for transmission as described above, the hearing aid controller 103 may control a hearing aid wireless unit 106 to transmit the characteristic data to the smart terminal 200 according to the pre-configured communication scheme.

The smart terminal 200, when receiving the characteristic data transmitted from the hearing aid 100 in operation 616, may compare the characteristic data with reference data in operation 618 and output the comparison result in operation 620. That is, the smart terminal controller 204 may receive the characteristic data through the second wireless communication unit 202 and the modem 203. The received characteristic data may be the input characteristic data, the output characteristic data, and the feedback characteristic data.

The smart terminal controller 204 may create comparable output characteristic data and comparable feedback characteristic data using the input characteristic data through a simulation program stored in a smart terminal memory 205. Alternatively, the smart terminal controller 204 may also have in advance the comparable output characteristic data and the comparable feedback characteristic data. The smart terminal controller 204 may check the state of the hearing aid by comparing the comparable characteristic data with the received characteristic data. That is, as illustrated in FIGS. 4A and 4B, the smart terminal controller 204 may check whether the received characteristic data is within a pre-configured margin of allowance.

The smart terminal controller 204 displays the comparison result on a display unit 206. The comparison result may be displayed as illustrated in FIGS. 7A and 7B.

Figure 7B:
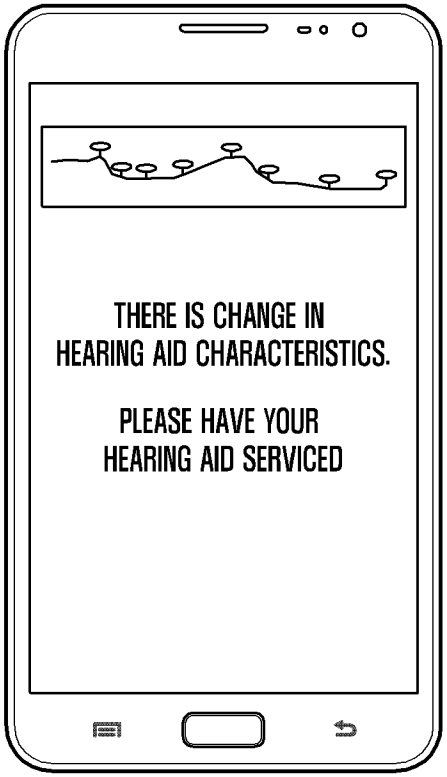
FIG. 7B illustrates examples of a display method for informing a user of a check result of a hearing aid state.
Figure 7A:
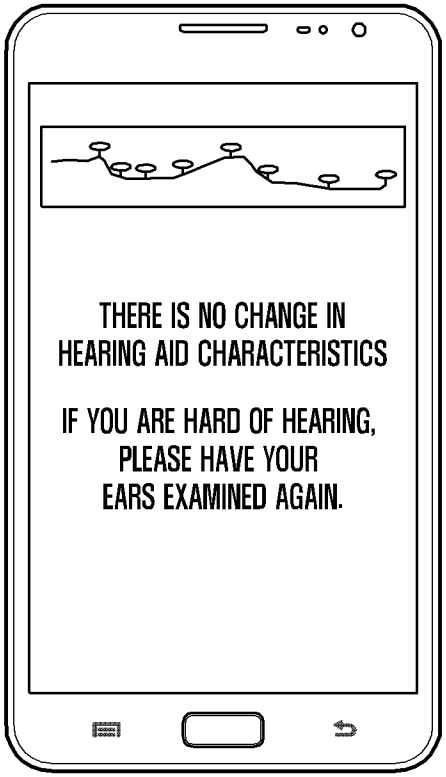
FIG. 7A illustrates examples of a display method for informing a user of a check result of a hearing aid state.

FIGS. 7A and 7B illustrate examples of a display method for informing a user of the check result of the hearing aid state.

In a state in which there is no change in the characteristics of the hearing aid 100, when a user requests information as to whether there is a change in the state of the hearing aid using the smart terminal 200, as illustrated in FIG. 7A, the smart terminal controller 204 may display a message "There is no change in hearing aid characteristics." on the display unit 206, and in addition, may display a message "If you are hard of hearing, please have your ears examined again." as an additional action. Furthermore, the check result may be provided through not the simple message but also various means, including various visual display means such as an icon, sounds, vibrations, and the like, which the user may identify.

Meanwhile, in a state in which there is a change in the characteristics of the hearing aid 100, when a user requests information as to whether there is a change in the state of the hearing aid using the smart terminal 200, as illustrated in FIG. 7B, the smart terminal controller 204 may display a message "There is a change in hearing aid characteristics." on the display unit 206, and in addition, may display a message "Please have your hearing aid serviced." as an additional action. Even in this case, the check result may be provided through various means, including various visual display means such as an icon, sounds, vibrations, and the like, which the user may identify.

The presently-described embodiment of the invention may be applied to all previously described embodiments. In this embodiment of the present invention, a smart terminal or a hearing aid itself, when detecting an abnormality within the hearing aid, may transmit data related to the abnormality to a server of a pre-specified medical institution.

For example, when the abnormality of the hearing aid 100 is detected through the smart terminal 200, the smart terminal 200 may create a notification of the abnormality of the hearing aid 100 and transmit it to the pre-configured medical institution or a repair center. At this time, the abnormality of the hearing aid may be transmitted using various networks, such as a mobile communication data network, a Wi-Fi network, or the like.

In addition, when a user monitors for a change in characteristics of the hearing aid 100 using the smart terminal 200, or inputs the user's inconvenience of hearing to the smart terminal 200 when there is no abnormality in the hearing aid 100, the smart terminal 200 may also be configured to transmit the user's state information to the server of the pre-stored medical institution.

Figure 8:
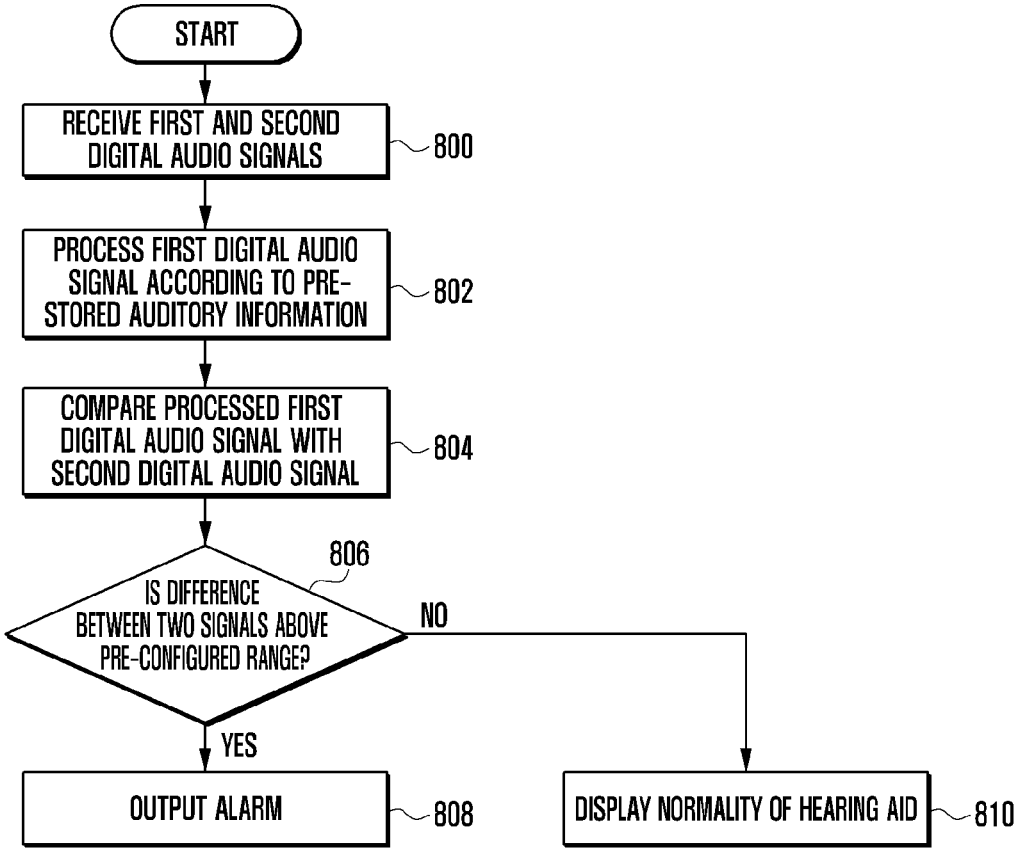
FIG. 8 is a flowchart illustrating an example process of detecting characteristics of a hearing aid and abnormality of a receiver by a smart terminal according to an embodiment of the present invention.

FIG. 8 is a flowchart illustrating an example process of detecting characteristics of a hearing aid and abnormality of a receiver by a smart terminal according to an embodiment of the present invention.

Operations in FIG. 8 may be automatically performed at a period previously configured by a user or at pre-configured time, or may be performed when the user makes a request to detect the characteristics of the hearing aid and the abnormality of the receiver. Although the user may input the pre-configured period or the pre-configured time, a specific application may also configure it automatically. When there exists a hospital or a pre-configured center, the operations may be performed based on a request signal received from the hospital or the pre-configured center through a wireless or wired network or according to time or a period configured in the hospital or the pre-configured center.

Hereinafter, the above-described case or any case similar thereto, in which it is requested to detect the characteristics of the hearing aid and the abnormality of the receiver, will be described with reference to FIG. 8.

In operation 800, a smart terminal controller 204 receives a first digital audio signal and a second digital audio signal. At this time, the smart terminal controller 204 receives the first and second digital audio signals through a wired communication scheme when the smart terminal is connected with the hearing aid in a wired manner, and/or through a wireless communication scheme when the smart terminal is connected with the hearing aid in a wireless manner.

Here, the first digital audio signal may be obtained by converting an analog audio signal acquired by a microphone of the hearing aid into a digital signal by a first analog-to-digital converter 102. Furthermore, there may be two types of second digital audio signal. One is a digital audio signal which will be amplified by a hearing aid controller 103 according to hearing of a hearing aid wearer and converted into an analog signal for an output to a speaker (SPK). The other may be a signal which has been converted into a digital signal by a second analog-to-digital converter 109 after being received through a sub-microphone (Sub_MIC).

The first and second digital audio signals may include information on a time at which they were generated. More specifically, the information of the first digital audio signal may be recorded at a time when the first digital audio signal was been generated or when an analog audio signal corresponding to the first digital audio signal was input. The information of the second digital audio signal may have been received at a time when the second digital audio signal was generated or when an analog audio signal was been first input to generate the second digital audio signal.

After receiving the first and second digital audio signals in operation 800, the smart terminal controller 204 processes the first digital audio signal according to auditory information previously stored in a smart terminal memory 205 in operation 802. That is, the smart terminal controller 204 may amplify the first digital audio signal according to amplification characteristics of the hearing aid wearer.

In operation 804, the smart terminal controller 204 may compare an audio signal obtained by processing the first digital audio signal with the second digital audio signal. That is, the signal processed into the same format as the second digital audio signal may be compared with the second digital audio signal. At this time, the two digital audio signals may be compared with each other through one or more of a method of comparing signal waveforms according to time corresponding to the signals, and a method of comparing signal waveforms according to frequencies corresponding to the signals.

After comparing the two signals, in operation 806, the smart terminal controller 204 determines whether a difference between the two signals is above a predetermined threshold. Information on the predetermined threshold may be information stored in the smart terminal memory 205. When it is determined in operation 806 that the difference between the two signals is above the predetermined threshold, the smart terminal controller 204 proceeds to operation 808, and if not, proceeds to operation 810.

When proceeding to operation 810, as illustrated in FIG. 7A, the smart terminal controller 204 may control a display unit 206 to inform the hearing aid wearer, namely, the user that the hearing aid is in the normal state.

In contrast, when proceeding to operation 808, the smart terminal controller 204 outputs an alarm. At this time, there may be three main methods of outputting the alarm. One is a method of outputting the alarm by the smart terminal 200, another is a method of outputting the alarm by the hearing aid, and the other is a method of outputting the alarm by both the smart terminal and the hearing aid. Accordingly, when the hearing aid outputs the alarm, the smart terminal controller 204 provides the alarm information based on the method through which the smart terminal is connected with the hearing aid 100.

When the smart terminal 200 outputs the alarm, the smart terminal controller 204 may provide the alarm using one or more of a visual graph, a text message, a pre-configured audible sound, a vibration, or a scent. Accordingly, the display unit 206 may output the visual graph, the text message, the pre-configured audible sound, the vibration, or the scent. Furthermore, if, the audible sound may also be output through a modem 203 and a speaker (SPK).

When the hearing aid 100 outputs the alarm likewise to the smart terminal 200, the hearing aid 100 may output a visual graph, a text message, a pre-configured audible sound, vibration, or scent through an alarm indication unit 107. Furthermore, as in the smart terminal 200, the audible sound may also be output through the speaker (SPK) which is a receiver of the hearing aid.

Figure 9:
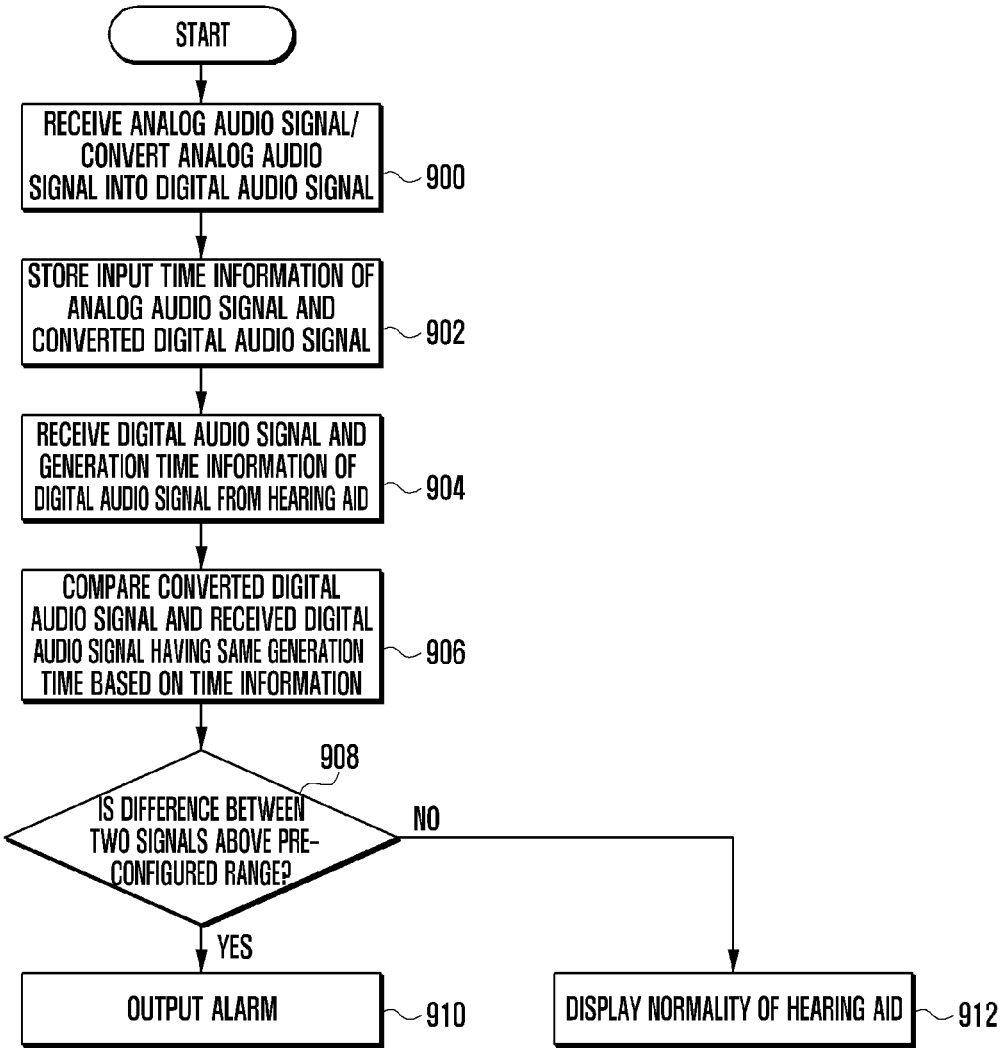
FIG. 9 is a flowchart illustrating an example process of detecting abnormality in a microphone of a hearing aid by a smart terminal according to an embodiment of the present invention.

FIG. 9 is a flowchart illustrating an example process of detecting an abnormality in a microphone of a hearing aid by a smart terminal according to an embodiment of the present invention.

Operations in FIG. 9 may be automatically performed at a period previously configured by a user or at pre-configured time, or may be performed when the user itself makes a request to detect characteristics of the hearing aid and abnormality of a receiver. Although the user may input the pre-configured period or the pre-configured time, a specific application may also configure it automatically. When there exists a hospital or a pre-configured center, the operations may be performed based on a request signal received from the hospital or the pre-configured center through a wireless or wired network or according to time or a period configured in the hospital or the pre-configured c enter.

Hereinafter, the above-described case or any case similar thereto, in which it is requested to detect abnormality in an audio signal input unit of the hearing aid, will be described with reference to FIG. 9.

In operation 900, a smart terminal controller 204 receives an analog audio signal through an audio processor and converts it into a digital audio signal. That is, the smart terminal controller 204 converts an electrical audio signal acquired by a microphone of a smart terminal 200 into a digital signal through a modem 203. Thereafter, in operation 902, the smart terminal controller 204 stores input time information of the analog audio signal and the converted digital audio signal in a smart terminal memory 205.

Then, in operation 904, the smart terminal controller 204 receives, from the hearing aid, a digital audio signal and information on time when the digital audio signal has been generated. At this time, the information on the generation time of the digital audio signal may also be transmitted while being included in the digital audio signal. The smart terminal controller 204, when connected with the hearing aid 100 through wireless communication, may receive the digital audio signal and the information on the time when the digital audio signal has been generated, according to the wireless communication scheme. Also, the smart terminal controller 204, when connected with the hearing aid 100 through wired communication, may receive the digital audio signal and the information on the time when the digital audio signal has been generated, according to the pre-configured wired communication scheme.

The digital audio signal received in operation 904 may be obtained by converting an analog signal input through a microphone of the hearing aid into a digital signal by a first analog-to-digital converter 102.

In operation 906, the smart terminal controller 204 compares the two digital audio signals based on the time information of the two digital audio signals. The comparison based on the time information implies that the two digital audio signals have been generated at the same time. The time information has been described above in detail with reference to FIG. 3, and therefore, a description thereof will be omitted herein.

After comparing the two digital audio signals generated at the same time in operation 906, the smart terminal controller 204 determines whether a difference between the two signals is above a predetermined threshold, in operation 908. The predetermined threshold may be a signal stored in the smart terminal memory 205. At this time, the two digital audio signals may be compared with each other through one or more of a method of comparing signal waveforms according to time corresponding to the signals and a method of comparing signal waveforms according to frequencies corresponding to the signals.

When it is determined in operation 908 that the difference between the two signals is above the predetermined threshold, the smart terminal controller 204 proceeds to operation 910, and if not, proceeds to operation 912.

When proceeding to operation 912, as illustrated in FIG. 7A, the smart terminal controller 204 may control a display unit 206 to inform a hearing aid wearer, namely, a user that the hearing aid is in the normal state.

In contrast, when proceeding to operation 910, the smart terminal controller 204 outputs an alarm. At this time, there may be three main methods of outputting the alarm. One is a method of outputting the alarm by the smart terminal 200, another is a method of outputting the alarm by the hearing aid, and the other is a method of outputting the alarm by both the smart terminal and the hearing aid. Accordingly, when the hearing aid outputs the alarm, the smart terminal controller 204 provides the alarm information based on the method through which the smart terminal is connected with the hearing aid 100.

When the smart terminal 200 outputs the alarm, the smart terminal controller 204 may provide the alarm using one or more of a visual graph, a text message, a pre-configured audible sound, vibration, or perfume. Accordingly, the display unit 206 should be able to output the visual graph, the text message, the pre-configured audible sound, the vibration, or the perfume. Furthermore, if desired, the audible sound may also be output through the modem 203 and a speaker (SPK).

When the hearing aid 100 outputs the alarm likewise to the smart terminal 200, the hearing aid 100 should be able to output a visual graph, a text message, a pre-configured audible sound, vibration, or perfume through an alarm indication unit 107. Furthermore, as in the smart terminal 200, the audible sound may also be output through a speaker (SPK) which is a receiver of the hearing aid.

The above-described embodiments of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer. No claim element herein is to be construed under the provisions of 35 U.S.C. 112, sixth paragraph, unless the element is expressly recited using the phrase "means for".

In addition, an artisan understands and appreciates that a "processor" or "microprocessor" constitute hardware in the claimed invention. Under the broadest reasonable interpretation, the appended claims constitute statutory subject matter in compliance with 35 U.S.C. §101.

The functions and process steps herein may be performed automatically or wholly or partially in response to user command. An activity (including a step) performed automatically is performed in response to executable instruction or device operation without user direct initiation of the activity.

The terms "unit" or "module" referred to herein is to be understood as comprising hardware such as a processor or microprocessor configured for a certain desired functionality, or a non-transitory medium comprising machine executable code, in accordance with statutory subject matter under 35 U.S.C. §101 and does not constitute software per se.

What is claimed is:

1. A method in an electronic device, comprising:

receiving via a communication unit an input audio signal and an amplified audio signal transmitted from a hearing aid;

simulating amplification of the input audio signal according to pre-stored auditory information and comparing the simulated amplified input audio signal and the amplified audio signal; and outputting an alarm signal when a difference between the simulated amplified input audio signal and the amplified audio signal is greater than a predetermined threshold.

2. The method of claim 1, wherein the input audio signal is a signal received by the hearing aid through a microphone of the hearing aid.

3. The method of claim 2, wherein the amplified audio signal comprises the input audio signal amplified by the hearing aid according to auditory information stored in advance, output to a speaker of the hearing aid, and at least partially fed back from the speaker through the microphone of the hearing aid.

4. The method of claim 1, wherein the simulated amplified audio signal is received via a sub-microphone disposed on a speaker-side of the hearing aid.

5. The method of claim 1, wherein the comparing of the simulated amplified input audio signal and the amplified audio signal comprises: comparing the simulated amplified input audio signal and the amplified audio signal according to at least one of time and frequencies.

6. The method of claim 1, wherein the alarm signal is output through at least one of the electronic device and the hearing aid.

7. The method of claim 1, wherein the alarm signal is output in the format of one or more of a visual graph, a text message, a pre-configured audible sound, a vibration, or a scent.

8. The method of claim 1, further comprising:

acquiring a third audio signal generated simultaneously with the input audio signal; and comparing the input audio signal and the third audio signal, and outputting an alarm when a difference between the input audio signal and the third audio signal is beyond a second predetermined threshold.

9. A device for detecting a change in characteristics of a hearing aid, comprising:

a communication unit configured to communicate with the hearing aid;

a display unit configured to display notifications of abnormalities in the hearing aid;

a memory configured to store an amplification factor of the hearing aid and an allowable error range of the amplification factor; and a controller configured to:

receive via the communication unit an input audio signal and an amplified audio signal transmitted from the hearing aid, simulate amplification of the input audio signal utilizing the amplification factor stored in the memory and compare the simulated amplified input audio signal with the amplified audio signal, and display an alarm signal on the display unit when a difference between the simulated amplified input audio signal and the amplified audio signal is greater than a predetermined threshold.

10. The device of claim 9, wherein the amplified audio signal comprises the input audio signal amplified by the hear aid according to the amplification factor, output to a speaker of the hearing aid, and at least partially fed back from the speaker through a microphone of the hearing aid.

11. The device of claim 9, wherein the amplified audio signal is received by the hearing aid from a sub-microphone disposed on a speaker-side of the hearing aid.

12. The device of claim 9, wherein the controller compares the simulated amplified audio signal with the amplified audio signal through comparing signal waveforms according to at least one of time and frequencies.

13. The device of claim 9, wherein the communication unit is further configured to transmit and receive data to and from the hearing aid in a wired or wireless manner.

14. The device of claim 9, wherein the controller is configured to cause, via the communication unit, the alarm signal to be output through the hearing aid.

15. The device of claim 9, wherein when the alarm signal is output through the display unit, the controller is further configured to output the alarm signal through one or more of a visual graph, a text message, a pre-configured audible sound, a vibration, or a scent.

16. The device of claim 9, wherein:

in response to receiving a request to detect any abnormality in a microphone of the hearing aid, the controller is further configured to:

acquire a third audio signal generated simultaneously with the input audio signal and compare the input audio signal with the third audio signal, and display an on through the display unit when a difference between the input audio signal and the third audio signal is greater than a second predetermined threshold.

17. A device for detecting a change in a hearing aid, comprising:

a memory that stores an amplification factor of auditory information and an allowable error range for detection of a malfunction; and a controller configured to:

collect, via a microphone, sound in a pre-configured audio frequency band as an electrical audio signal, amplify, via an amplifier, the electrical audio signal that is output from the microphone according to pre-stored auditory information, convert and output the amplified electrical audio signal as an audible sound signal;

compare, with reference to the allowable error range, the audible sound signal with a signal generated by amplifying the electrical audio signal by the amplification factor to detect if the audible sound signal is fed back through an output route to a speaker, and generate an alarm when a difference between the audible sound signal and the signal generated by amplified the electrical audio signal is greater than the allowable error range.

18. The device of claim 17, further comprising:

a sub-microphone disposed on a speaker-side of the device, and configured to record the audible sound signal as it is output from the speaker, the comparing executed with the audible sound signal as recorded by the sub-microphone.

19. The device of claim 17, further comprising:

a communication unit configured to transmit and receive data to and from an external electronic device, wherein the controller transmits the generated alarm to the external electronic device through the communication unit for display through a display unit of the external electronic device.

20. The device of claim 17, wherein the comparing is executed by comparing signal waveforms according to at least one of time and frequencies.

* * * * *